United States Patent [19]

Akiba

[11] 3,977,416

[45] Aug. 31, 1976

[54] CIGARETTE WITH A SNUFFER

[76] Inventor: Minoru Akiba, 5-28, Yasui-cho, Kagoshima, Kagoshima, Japan

[22] Filed: Sept. 18, 1974

[21] Appl. No.: 507,222

[30] Foreign Application Priority Data

Sept. 22, 1973 Japan ..... 48-111307

[52] U.S. Cl. ..... 131/4 A; 131/256

[51] Int. Cl.[2] ..... A24D 1/10; A24D 1/12

[58] Field of Search ..... 131/4 A, 256, 9, 235 R

[56] References Cited

UNITED STATES PATENTS

| | | | |
|---|---|---|---|
| 1,581,451 | 4/1926 | Knapp | 131/4 A |
| 1,931,131 | 10/1933 | Haley | 131/4 A |
| 2,013,508 | 9/1935 | Seaman | 131/4 A X |
| 2,049,320 | 7/1936 | Ruben et al. | 131/4 A |
| 2,536,900 | 1/1951 | Atterbury | 131/4 A |
| 2,666,437 | 1/1954 | Lattof | 131/4 A |
| 2,718,889 | 9/1955 | Claussen | 131/4 A |
| 2,778,365 | 1/1957 | Silverman et al. | 131/235 R |
| 2,923,647 | 2/1960 | Aghnides | 131/9 |
| 3,102,543 | 9/1963 | O'Siel et al. | 131/256 UX |

FOREIGN PATENTS OR APPLICATIONS

| | | | |
|---|---|---|---|
| 1,560,360 | 2/1969 | France | 131/4 A |
| 1,959,684 | 6/1971 | Germany | 131/4 A |
| 348,094 | 9/1960 | Switzerland | 131/4 A |

*Primary Examiner*—Robert W. Michell
*Assistant Examiner*—V. Millin

[57] ABSTRACT

A cigarette in combination with a snuffer wherein according to the invention the cigarette is provided with an extinguishing sleeve of incombustibilized paper or incombustible material such as aluminum foil so that a smoker can extinguish the remaining stub by wrapping it up with said sleeve, or by drawing the stub out of a cylindrical cavity formed within said extinguishing sleeve and thereafter thrusting the lit portion of said stub into said cylindrical cavity.

7 Claims, 11 Drawing Figures

CIGARETTE WITH A SNUFFER

BACKGROUND OF THE INVENTION

This invention relates to cigarettes, and more particularly to cigarettes adapted with snuffer.

The smokers usually extinguish their finished stubs in ash trays which are placed in the rooms, corridors and lobbies of buildings or in the gardens or other outdoor places where smokers smoke. If there are not such ash trays, the smokers have to extinguish their finished stubs by stamping them on the floors or on the ground.

The smokers experience inconveniences in disposing of their finished stubs particularly when they smoke cigarettes in a room without an ash tray, since an unextinguished stub can be a cause of a fire even when thrown away in outdoor places. Furthermore, the discarded cigarette stubs litter floors, ground and lawns, necessitating additional labor to keep them clean.

SUMMARY OF THE INVENTION

It is an object of the present invention to provide a cigarette adapted with a snuffer so as to eliminate the inconveniences and difficulties as experienced with the existing cigarettes.

According to the invention, there is provided a cigarette, comprising a filter generally of a cylindrical shape, a cigarette having a cylindrical thin paper cover open at opposite ends and a roll of stuffed tobacco therein, a sleeve of an incombustible material having one end fit over and adhesively secured around the circumference of said filter and the other end forming a cylindrical extension projecting outwardly toward and over said cigarette, said extension of said extinguishing sleeve having a cylindrical cavity releasably holding one end of said roll of tobacco. The sleeve may be formed from an incombustibilized paper sheet, or a hardly combustible paper or an incombustible material. The smoker can enjoy the cigarette in the same manner as with a filter-tipped cigarette up to the margin of the cylindrical extension. The cigarette becomes extinguished of itself if left as it is, but it is desirable to extinguish it positively by wrapping the lit portions of the cigarette in the cylindrical extinguishing sleeve. On the other hand, when the cigarette stub to be discarded has a substantial length, it is drawn out from the cylindirical cavity of the extinguishing sleeve and then the opposite lit end of the cigarette is thrusted into the sleeve to extinguish itself within the limited space of the cylindrical cavity therefor. The extinguished cigarette can be quite safely kept in a the cigarette packet or in a pocket without littering the environment.

BRIEF DESCRIPTION OF THE DRAWING

The above and other objects, features and advantages of the invention will become clear from the following particular description of the invention and from the appended claims, taken in conjunction with the accompanying drawings which show by way of example several preferred embodiments of the invention and wherein:

PARTICULAR DESCRIPTION OF THE INVENTION

Figure 1:
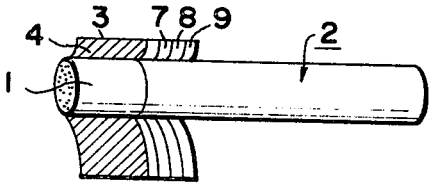
FIG. 1 is a perspective view showing a cigarette with a snuffer embodying the present invention with the sleeve shown in open, developed form.
Figure 2:
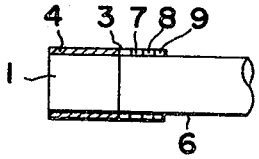
FIG. 2 is a partial sectional view showing on an enlarged scale the snuffer tip mounted on the cigarette of FIG. 1.

Referring to FIG 1, the cigarette in combination with the snuffer according to the invention comprises a filter 1 generally of a cylindrical shape, a cigarette 2 having finely-cut tobacco (not shown) rolled in a cylindrical thin paper cover 6 open at both ends, and an extinguishing sleeve 3. This extinguishing sleeve 3 is formed from a thin incombustibilized paper or from a suitable incombustible material such as aluminum foil and has one end fit over and securely adhered to the circumference of the filter 1 by means of any suitable adhesive agent 4 such as is well known in the manufacture of cigarettes. The other end of the cylindrical sleeve 3 is extended outwardly to form a cylindrical cavity for receiving one end of the cigarette 2. The inner surface of the extinguishing sleeve 3 contacting the paper cover of the cigarette 2 is free from the adhesive agent 4 and the cigarette 2 is retained releasably within the cylindrical cavity of the extinguishing sleeve 3 by paper cover 6 of the cigarette 2, so that the cigarette 2 may be drawn out of the cylindrical cavity of the extinguishing sleeve 3 by pulling the former with one's fingers if desired. The extinguishing sleeve 3 has an extinguishing layer 7 of a suitable material such as powdered sodium bicarbonate or powdered amonium phosphate on the inner surface of the cylindrical extension to ensure extinction of the cigarette when the lit end of the cigarette is inserted into the cylindrical cavity.

The inner surface of the cylindrical cavity of the extinguishing sleeve 3 is further provided with a layer 8 of a heat-sensitive adhesive powder made of glue or silicone resin so that when the lit end portion of the cigarette is thrusted into the cylindrical cavity of the extinguishing sleeve 3, the lit end portion is held securely therein by the adhesive powder. The extinguishing sleeve 3 has adhesively connected to the marginal edge of the cylindrical extension a thin expansible member 9 of an annular shape and of a material which has a thermal expansion coefficient larger than that of the extinguishing sleeve 3. The expansible member 9 is expanded by the heat of the lit end portion of the cigarette and serves to facilitate the insertion of the cigarette 2 into the cylindrical cavity of the extinguishing sleeve 3.

Figure 3:
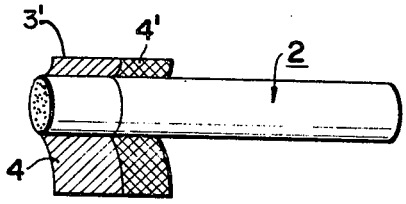
FIG. 3 is a perspective view similar to FIG. 1 showing another embodiment according to the invention with the sleeve shown in open, developed form.
Figure 4:
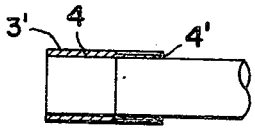
FIG. 4 is a partial sectional view similar to FIG. 2 showing on an enlarged scale the snuffer tip of the cigarette shown in FIG. 3.

Referring to the modification shown in FIGS. 3 and 4, the cylindrical extension of the extinguishing sleeve 3' which is in contact with the outer surface of the cigarette 2 is internally coated with an incombustible non-adhesive film layer of such as aluminum foil or glass fiber.

An adhesive agent such as starch thickening is applied over the entire inner surface of the extinguishing sleeve 3' before putting the sleeve around the filter 1 and the cigarette 2, including the area with the just-mentioned non-adhesive layer. As a result, the filter 1 and the extinguishing sleeve 3' are adhesively bonded to each other, however, the adhesive agent on the inner surface of the cylindrical extension contacting the cigarette 2 is deposited on the external surface of the latter to form thereon a layer 4', of the transferred adhesive, without allowing adhesive bondage between the extinguishing sleeve 3' and the cigarette paper 6 due to the existence of the non-adhesive film layer on the outer surface of the cigarette 2. Thus, the sleeve 3' releasably holds the cigarette 2 within the cylindrical cavity over the layer of the adhesive agent deposited on the cigarette paper.

Figure 5:
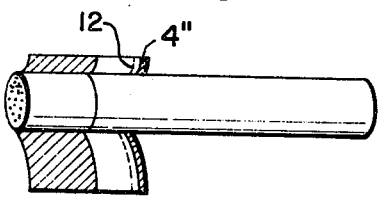
FIG. 5 is a perspective view similar to FIG. 1 showing still another embodiment of the invention with the sleeve shown in open, developed form.
Figure 6:
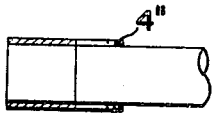
FIG. 6 is a partial sectional view similar to FIG. 2 showing on an enlarged scale the snuffer tip of the cigarette shown in FIG. 5.

Referring to FIGS. 5 and 6 which show another modification according to the invention, the inner surface of the cylindrical extinguishing sleeve 3 is applied with an adhesive agent only in the area which is wound around the circumference of the filter 1 and a narrow area 4'' in the form of an annular stripe along the marginal edge of the cylindrical extension, as indicated by hatching. The extinguishing sleeve 3 is formed with perforations 12 the narrow adhesive layer 4'' so that the cigarette 2 which is normally retained in the cylindrical cavity of the sleeve 3 by the adhesive layer 4'' may be separated from the sleeve 3 easily along the perforations 12 when it is desired to thrust the opposite lit end of the cigarette into the cylindrical cavity of the sleeve 3 for extinction.

Figure 7:
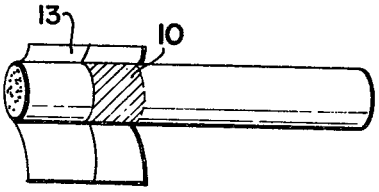
FIG. 7 is a perspective view showing similar to FIG. 1 still another embodiment of the invention with the sleeve shown in open, developed form.

Still another embodiment according to the invention is shown in FIG. 7. It shows a cigarette with snuffer, comprising: a cigarette having a cylindrical thin paper cover open at both ends; a filter of a cylindrical shape and provided at one end of said cigarette; an extinguishing sleeve made of an incombustibilized paper sheet, hardly combustible paper or incombustible material applied around said filter and a part of said cigarette; said extinguishing sleeve having an inner side coated with adhesive material 13, and said thin cover paper of the cigarette being coated or soaked at the end facing said extinguishing sleeve with an adhesive weakening agent as shown at 10 with hatched lines; the extension of said extinguishing sleeve having a cylindrical cavity for releasably holding therein the end of said cigarette.

Figure 8:
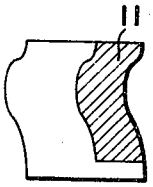
FIG. 8 is a view developed showing a sleeve of still another embodiment of the invention.

A still further embodiment according to the invention is shown in FIG. 8. In this case a cigarette with self-extinguishable tip comprises: a cigarette having a cylindrical thin paper cover and open at both ends (not shown); a filter (not shown) of a cylindrical shape and provided at one end of said cigarette; an extinguishing sleeve made of an incombustibilized paper sheet, hardly combustible paper or incombustible material and coated on its inner side with adhesive material 11 so as to be secured to the circumference of said filter and having a cylindrical extension projecting toward said cigarette; said extension of said extinguishing sleeve being coated with adhesive weakening material on its inner side and having a cylindrical cavity for releasably holding therein one end of said cigarette. In other words, the adhesion weakening agent is applied not to the paper (FIG. 7), but to the sleeve.

Figure 9:
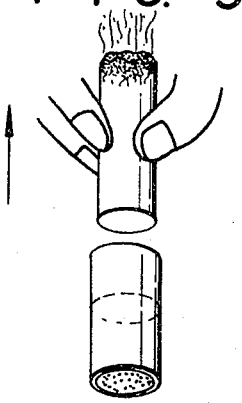
FIG. 9 is a perspective view showing a cigarette stub which is drawn out of the cylindrical sleeve shown in any one of the preceding embodiments, for example the embodiment of FIG. 3.
Figure 10:
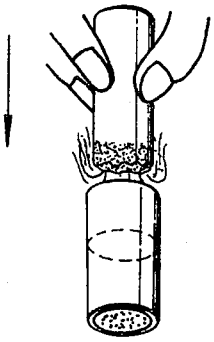
FIG. 10 is a perspective view showing a lit portion of a cigarette stub which is thrusted into the cylindrical sleeve shown in FIG. 9 to extinguish itself.
Figure 11:
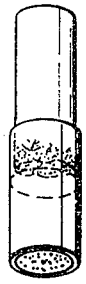
FIG. 11 is a perspective view showing a stub of which the lit portion has been extinguished within the cylindrical sleeve shown in FIG. 9.

FIG. 9 shows by way of example a cigarette stub 2 which is drawn out of its cylindrical sleeve 3, both of which may be as shown in the embodiment of FIG. 3; FIG. 10 shows a lit portion of a cigarette stub which is thrusted into the cylindrical sleeve to extinguish itself: and FIG. 11 shows a stub 2 of the lit portion of which has been extinguished within the cylindrical sleeve 3.

In the embodiment shown in FIG. 5, should the smoker desire to smoke the cigarette without the filter 1, the cigarette 2 may be drawn out from the cylindrical cavity of the extinguishing sleeve 3 or separated from the latter by tearing along the mentioned perforations as previously described before lighting, after smoking thrusting the lit end of the finished stub for extinction into the cylindrical cavity of the extinguishing sleeve which has been kept separately by the smoker in a pocket or in the cigarette packet.

The filter 1 has been described and shown as being of the single filter type in the foregoing embodiments, however, it will be appreciated that a multiple number of disc type filters of acetate or active carbon may be connected one after another in the longitudinal direction of the cigarette, if desired.

While there have been shown and described several embodiments in accordance with the present invention, it is understood that the same is not limited thereto but is susceptible of various changes and modifications by the person skilled in the art without departing from the spirit and scope of the invention as defined in the appended claims.

What is claimed is:

1. A cigarette with a snuffer, which comprises, in combination:

a. a tobacco-filled cylindrical, open-ended paper enveloped cigarette portion having an end that is adapted to be lit;

b. at least one cylindrical smoke-filtering portion removably attached adjacent the end of said cigarette portion that is opposite to the end that is adapted to be lit; and c. an extinguishing sleeve made of a material that is non-combustible at the temperature of the lit portion of the cigarette when the cigarette is burning, said sleeve being secured to the said filtering portion and having a tubular, cylindrical extension defining a cavity projecting toward and normally encasing the end of said cigarette portion that is not lit, said extension cavity of said sleeve receiving therein the lit end of said cigarette portion when it is desired to extinguish the cigarette, said extinguishing sleeve further including:

1. a layer of a non-combustible material coated on at least a portion of the inner surface of said cylindrical extension.

2. A cigarette as defined in claim 1, wherein a layer of an adhesive agent is provided on the inner surface of said cylindrical extension of said extinguishing sleeve, said adhesive agent being adapted to adhere to said cigarette portion but not the inner surface of said cylindrical extension that is in opposition to said smoke filtering portion.

3. A cigarette as defined in claim 1, wherein said extinguishing sleeve is provided with an annular, marginally located layer of an adhesive agent on the inner surface of said cylindrical extension at the end thereof that is remote from said smoke filtering portion and wherein severing perforations are provided adjoining said marginal annular layer.

4. A cigarette as defined in claim 1, wherein said extinguishing sleeve has its inner surface wholly coated with an adhesive material, and said cigarette portion is coated on said one end thereof with an adhesive-weakening agent for quick release of said cigarette portion from said sleeve.

5. A cigarette as defined in claim 1, wherein said extension of said extinguishing sleeve is coated with adhesive-weakening agent on its inner surface for quick release of said cigarette portion from said sleeve.

6. A cigarette with a snuffer which comprises, in combination:

a. a tobacco-filled cylindrical, open-ended, paper enveloped cigarette portion having one end that is adapted to be lit and another end that is coated with an adhesive weakening agent;

b. at least one separable cylindrical smoke-filtering portion adjacent the end of said cigarette portion that is coated with said adhesive weakening agent; and c. an extinguishing sleeve made of a material that is non-combustible at the temperature of the lit portion of the cigarette when the cigarette is burning, said sleeve being adhesively secured to the outer surface of said filtering portion and having a tubular, cylindrical extension defining a cavity projecting toward and normally encasing said end of said cigarette portion that is coated with said adhesive weakening agent, the inner surface of said extinguishing sleeve being wholly coated with an adhesive material, said extension cavity receiving therein the lit end of said cigarette portion when it is desired to extinguish the cigarette.

7. A cigarette with a snuffer which comprises, in combination:

a. a tobacco-filled cylindrical, open-ended paper-enveloped cigarette portion having an end that is adapted to be lit;

b. at least one separable cylindrical smoke-filtering portion adjacent one end of said cigarette portion opposite the end of the cigarette that is lit; and c. an extinguishing sleeve made of a material that is non-combustible at the temperature of the lit portion of the cigarette when the cigarette is burning, said sleeve being adhesively secured to the outer surface of said filtering portion and having a tubular, cylindrical extension defining a cavity projecting toward and normally encasing said end of said cigarette portion that is not lit, said extension of said extinguishing sleeve being coated with an adhesive-weakening agent on its inner surface for quick release of said cigarette portion from said sleeve, said extension cavity receiving therein the lit end of said cigarette portion when it is desired to extinguish the cigarette.

* * * * *